US010584661B2

(12) United States Patent
Glass

(10) Patent No.: US 10,584,661 B2
(45) Date of Patent: Mar. 10, 2020

(54) CARBURETOR WITH IDLE DOWN FEATURE

(71) Applicant: Liquid Combustion Technology, LLC, Travelers Rest, SC (US)

(72) Inventor: Douglas Lloyd Glass, Travelers Rest, SC (US)

(73) Assignee: LIQUID COMBUSTION TECNOLOGY, LLC, Travelers Rest, SC (US)

( * ) Notice: Subject to any disclaimer, the term of this patent is extended or adjusted under 35 U.S.C. 154(b) by 74 days.

(21) Appl. No.: 15/856,725

(22) Filed: Dec. 28, 2017

(65) Prior Publication Data

US 2018/0119648 A1 May 3, 2018

Related U.S. Application Data

(63) Continuation of application No. 15/144,001, filed on May 2, 2016, now Pat. No. 9,863,369, which is a continuation of application No. 14/164,304, filed on Jan. 27, 2014, now Pat. No. 9,328,696.

(60) Provisional application No. 61/756,537, filed on Jan. 25, 2013.

(51) Int. Cl.

| | |
|---|---|
| ***F02M 3/00*** | (2006.01) |
| ***F02M 3/08*** | (2006.01) |
| ***F02M 1/02*** | (2006.01) |
| ***F02M 3/14*** | (2006.01) |
| ***F02D 11/02*** | (2006.01) |
| ***F02D 11/04*** | (2006.01) |
| ***F02M 3/12*** | (2006.01) |
| *F02B 63/02* | (2006.01) |
| *E01H 5/04* | (2006.01) |

(52) U.S. Cl.

CPC ..... *F02M 3/14* (2013.01); *F02D 11/02* (2013.01); *F02D 11/04* (2013.01); *F02M 1/02* (2013.01); *F02M 3/00* (2013.01); *F02M 3/08* (2013.01); *F02M 3/12* (2013.01); *E01H 5/04* (2013.01); *F02B 63/02* (2013.01)

(58) Field of Classification Search

CPC ..... F02M 3/00; F02M 3/08; F02M 1/02
USPC ..... 261/38, 42, 64.1, 64.6; 123/179.1
See application file for complete search history.

(56) References Cited

U.S. PATENT DOCUMENTS 5,174,255 A * 12/1992 Collins ..... A47L 5/14 123/179.1

* cited by examiner

*Primary Examiner* — Robert A Hopkins
(74) *Attorney, Agent, or Firm* — J. Bennett Mullinax, LLC

(57) ABSTRACT

A carburetor with a throttle valve is provided in which a linkage member is in communication with the throttle valve. An idle down handle can be moved from an unactuated position to an actuated position and is in communication with the throttle valve. Movement of the idle down handle to the actuated position causes the throttle valve to be placed into the closed position. When the idle down handle is in the unactuated position the throttle linkage member can cause the throttle valve to be moved back and forth between the open and closed positions.

5 Claims, 12 Drawing Sheets

CARBURETOR WITH IDLE DOWN FEATURE

RELATED APPLICATIONS

This application claims the benefit of U.S. Provisional Application No. 61/756,537 filed on Jan. 25, 2013 and which is incorporated herein by reference.

FIELD OF THE INVENTION

The present invention relates to a carburetor that includes an idle down feature that can be actuated to cause the carburetor to enter idle operation. More particularly, the present application involves a carburetor for a snow blower that includes an idle down feature that can be actuated independently of a choke of the carburetor and in a fast manner to cause the carburetor to enter idle operation.

BACKGROUND

A carburetor is used in an internal combustion engine to control a mixture of fuel and air that is provided to run the engine. Air may first flow through an air filter before entering the carburetor. A choke valve can be opened and closed in order to allow air to enter an air passage of the carburetor. The air passage may contain a venturi in which the size of the air passage is restricted. The venturi can be variously configured in different arrangements of carburetors and may in some instances even be absent. Fuel can be drawn into the venturi or other portion of the air passage through the carburetor. A throttle valve is present that can also be opened and closed in order to regulate the air and/or fuel that is being transferred out of the carburetor from the venturi.

In order to start a cold engine, the choke valve is closed to prevent or minimize air entry into the venturi. A throttle valve is opened and a vacuum can be created which draws fuel into the venturi so that the mixture leaving the carburetor through the throttle valve has an increased amount of fuel. Once the engine has warmed and has been run for some length of time, the choke valve can be opened in order to provide a more optimum mixture of fuel and air to the engine. The user can close the throttle valve to decrease air flowing through the venturi. The engine will enter an idle state when this is done and a vacuum created by this closure will function to draw a minimum amount of fuel and air through apertures that allow the engine to run in an idle condition.

The placement of an engine into an idle condition is done by actuating the throttle valve through actuation of a power controller linked to the throttle valve. The power controller may have a "fast" setting, a "slow" setting, and a "stop" setting in which the throttle valve is opened or closed varying amounts. Although capable of causing the throttle to close to an idle it may be the case that the user inadvertently shuts off the engine instead of simply placing it into an idle. Further, if the power controller is a lever the user may inadvertently place the lever into the wrong position and subsequently fail to place the engine into idle. Also, snow or other elements may cover or enter the power controller, for example when the engine is that of a snow blower, thus preventing or making it difficult for one to properly actuate the power controller. Additionally, the power controller may be in a spot that is not convenient or easy for the user to actuate in order to place the engine into an idle condition. As such, there remains room for variation and improvement within the art.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended FIGS. in which.

Figure 1:
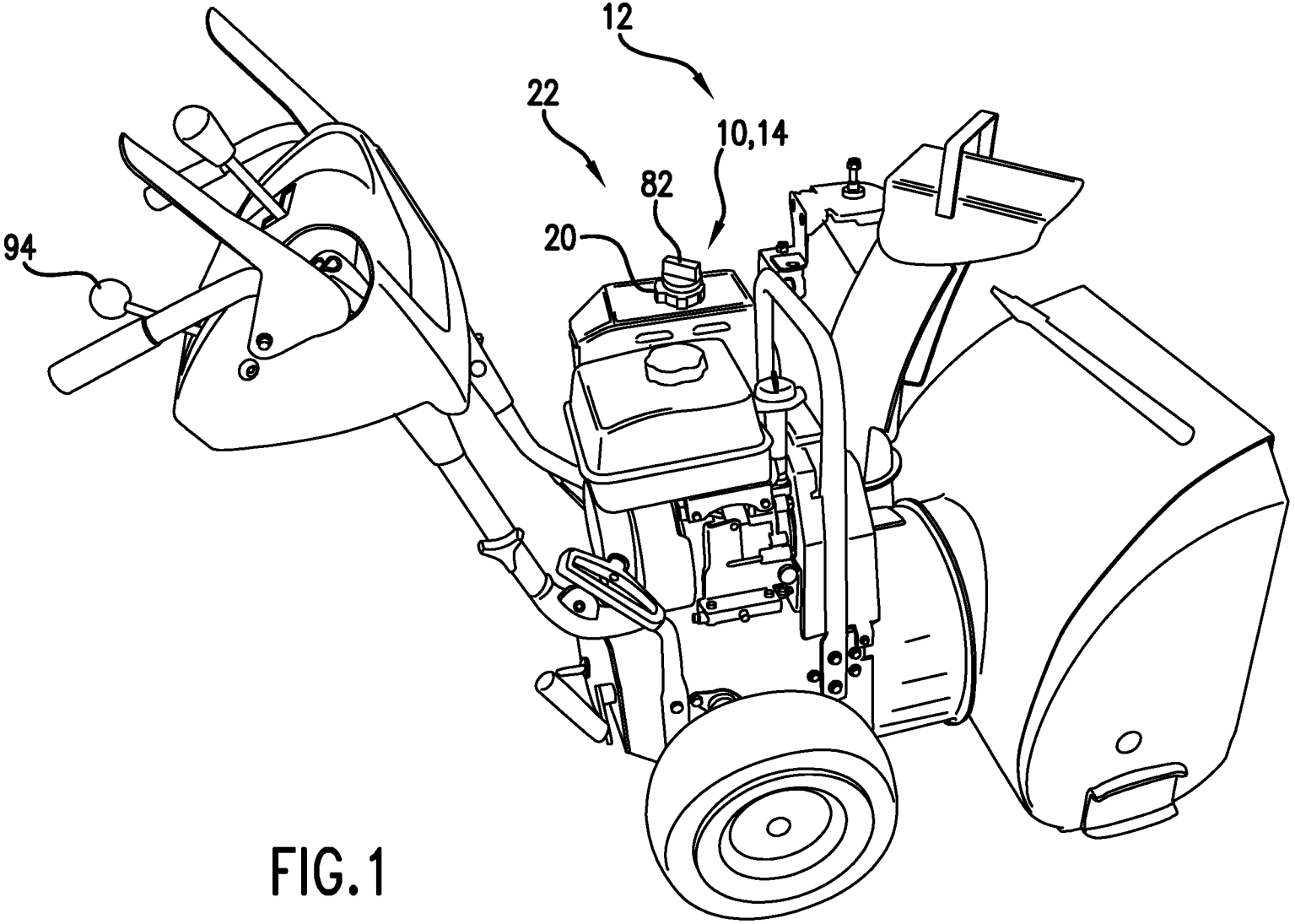
FIG. 1 is perspective view of a snow blower that employs a carburetor in accordance with one exemplary embodiment.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for a carburetor 10 that has an idle down feature 14 that allows the user to quickly place the engine into an idle state. The idle down feature 14 may be in addition to the normal throttle/accelerator that may likewise function to cause the engine to be changed from a full power to an idle condition. The idle down feature 14 may thus be an easier, faster, and more convenient mechanism for the user to quickly idle down the engine.

The carburetor 10 that includes the idle down feature 14 may be used in combination with any type of engine or device. For purposes of example only, one embodiment includes the carburetor 10 and idle down feature 14 employed with a snow blower 12 as shown in FIG. 1. The user may employ a normal power controller 94 to cause the engine to run at full power, three-quarter power, half-power, one-quarter power, or idle. Alternatively, should the user wish to quickly and easily, or simply alternatively, reduce power of the snow blower 12 to idle, he or she may actuate an idle down handle 20 located on the snow blower 12. The only portions of the carburetor 10 that may be visible to the user during normal use may be the idle down handle 20 and a choke handle 82 while the other components of the carburetor 10 are hidden behind shielding.

Figure 2:
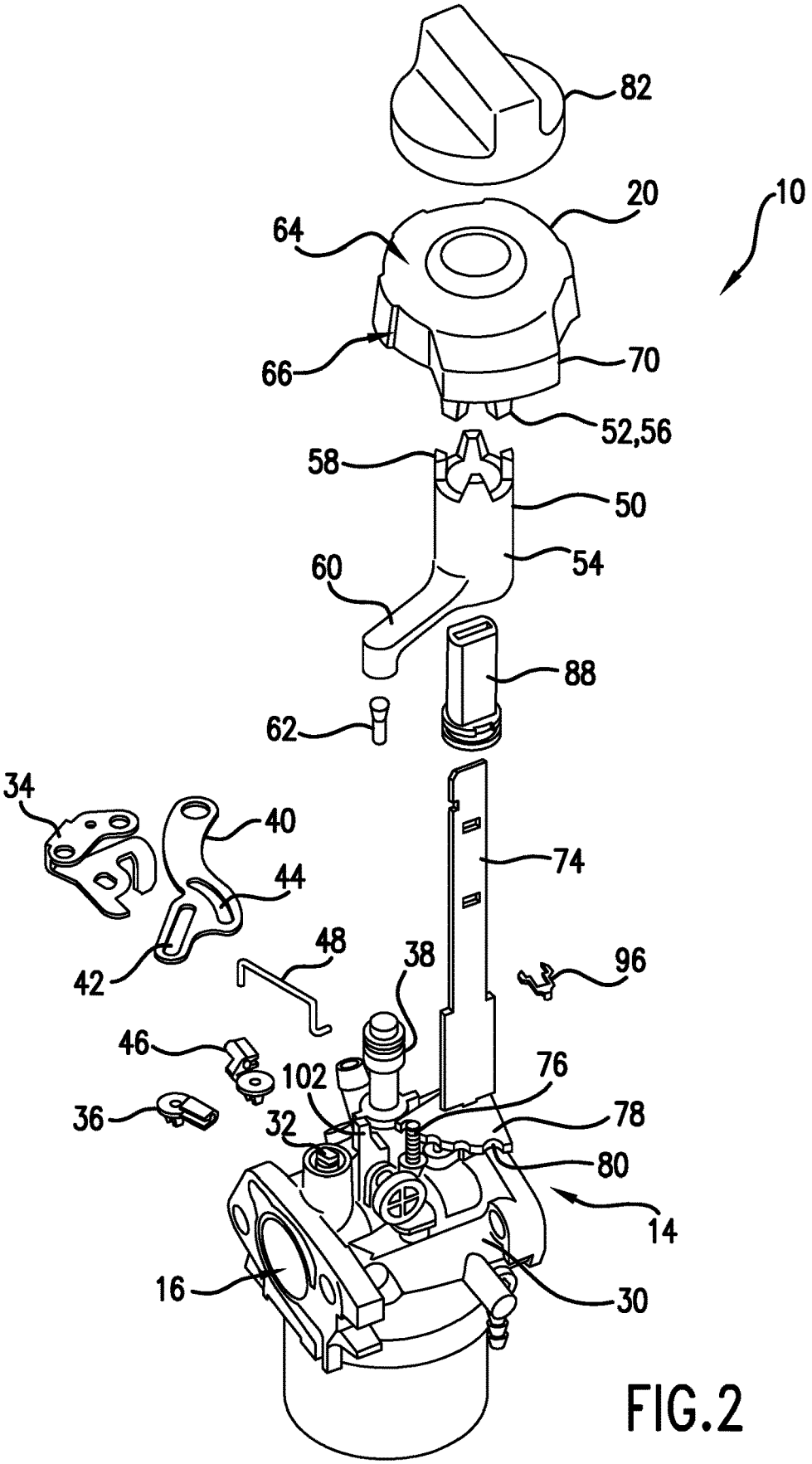
FIG. 2 is an exploded assembly perspective view of the carburetor of FIG. 1.

With reference now to FIG. 2, an exploded assembly view of the carburetor 10 is shown. The choke handle 82 can be rotated by the user to open and close a choke valve 72 of the carburetor 10. The idle down handle 20 can be rotated from an unactuated position 22 to an actuated position 24 in order to close a throttle valve 16. The idle down handle 20 functions independently of the choke handle 82 in so far as actuation of the idle down handle 20 does not move the choke handle 82 or the choke valve 72. In a similar manner, the choke handle 82 is independent of the idle down handle 20 in that movement of the choke handle 82 does not cause any movement of the idle down handle 20 or the throttle valve 16.

Figure 3:
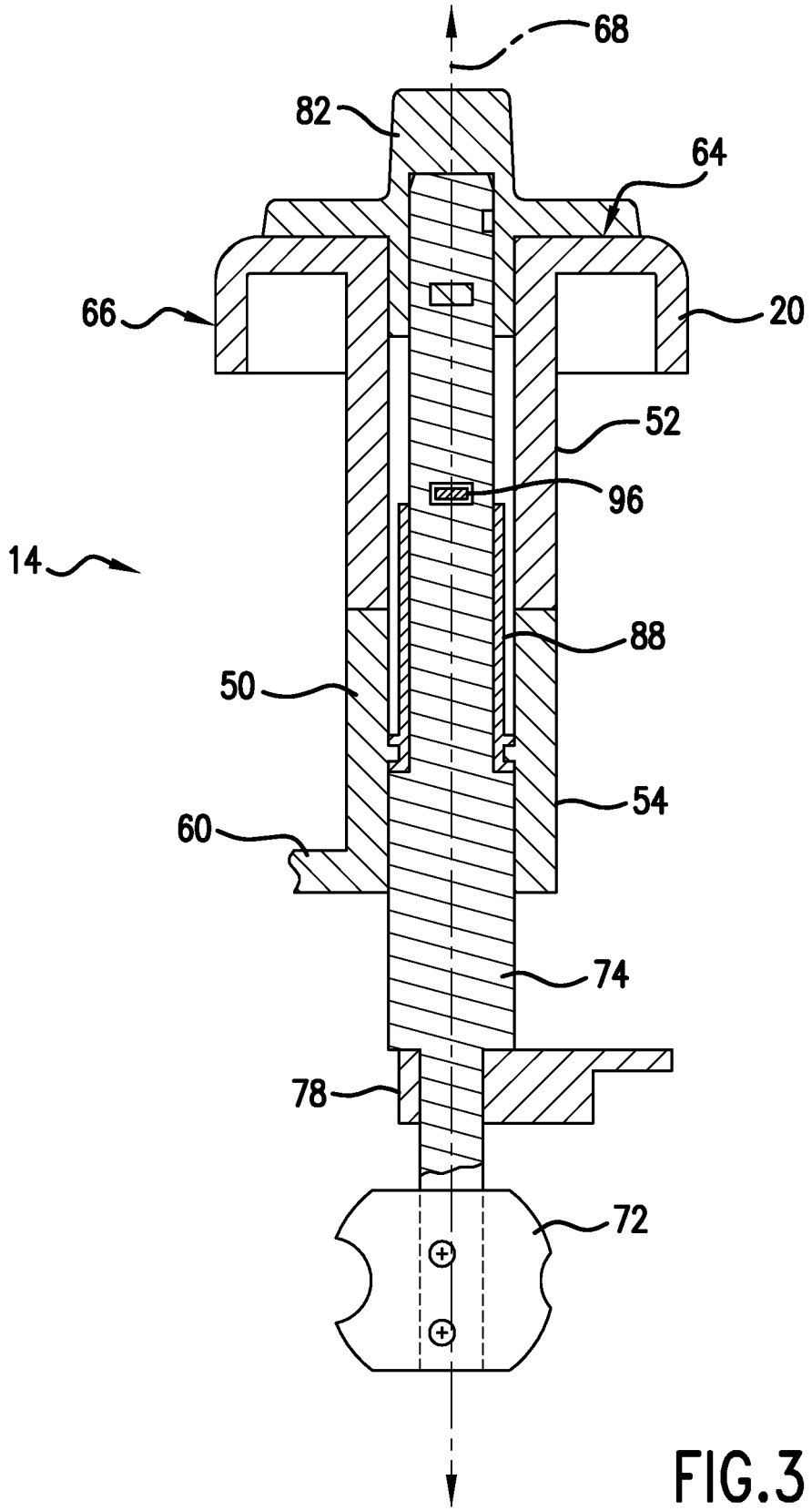
FIG. 3 is a cross-sectional view of portions of the idle down feature and of the choke valve and associated components used to open and close the choke valve.

FIG. 3 is a cross-sectional view of certain portions of the carburetor 10 and shows the choke valve 72. The choke valve 72 is attached to a choke transmission member 74. This attachment may be a rigid attachment in which the choke transmission member 74 and the choke valve 72 do not move relative to one another. The choke transmission member 74 can be attached to the choke valve 72 through a bolted connection, rivets, welding, or by other mechanical fasteners. With reference to both FIGS. 2 and 3, the choke transmission member 74 can rotate relative to a housing 30 of the carburetor 10. In order to effect rotation, the user can grasp the choke handle 82 and rotate same. The choke handle 82 is rigidly attached to the choke transmission member 74 and these two components do not move relative to one another. Rotation of the choke handle 82 causes a corresponding rotation of the choke transmission member 74 which in turn causes a corresponding rotation of the choke valve 72.

In order to maintain the choke valve 72 in a desired position so that it will only rotate when desired, a coil spring engagement member 78 may be employed. The coil spring engagement member 78 is rigidly attached to the choke transmission member 74 and these two components do not rotate relative to one another. A deflectable coil spring 76 extends upwards from the housing 30 and is attached to the housing 30. The deflectable coil spring 76 is capable of being flexed, but is generally stiff. The coil spring engagement member 78 may have a plurality of detents 80 defined on its outer surface. The deflectable coil spring 76 is located within one of the detents 80. This placement prevents the coil spring engagement member 78, and hence the choke transmission member 74 and choke valve 72, from rotating. The choke valve 72 may thus be placed into a choke valve open position 84 and will maintain this positioning until the user desires the choke valve 72 be repositioned. Once repositioning is desired, the user may apply a force to the choke handle 82 sufficient to overcome the resistive engagement forces of the deflectable coil spring 76. In this regard, sufficient turning force applied by the user will cause the coil spring engagement member 78 to be urged against the deflectable coil spring 76 until it flexes to such a degree that it snaps out of the detent 80 allowing the coil spring engagement member 78 and the choke transmission member 74 to be free to turn. The user may continue to apply sufficient force to the choke handle 82 until the choke valve 72 is moved into a desired location thus causing the deflectable coil spring 76 to be located into the appropriate detent 80.

The choke transmission member 74 has a generally rectangular cross-section and extends in a longitudinal direction along the longitudinal axis 68. A rotational member 88 engages the choke transmission member 74 and surrounds a portion of the choke transmission member 74 along the entire longitudinal length of the rotational member 88. The rotational member 88 may have an aperture that is slotted in shape so as to receive the corresponding rectangular cross-sectional shape of the choke transmission member 74. The choke transmission member 74 may have a step that engages the bottom end of the rotational member 88. A step is formed by increasing the width of the choke transmission member 74 at this point. On an opposite end, an aperture can extend completely through the choke transmission member 74 and a snap spring 96 can be disposed through the aperture and dipped onto the choke transmission member 74. The snap spring 96 may thus form an upper boundary to prevent upward longitudinal movement of the rotational member 88 past the snap spring 96 along the longitudinal axis 68.

Figure 4:
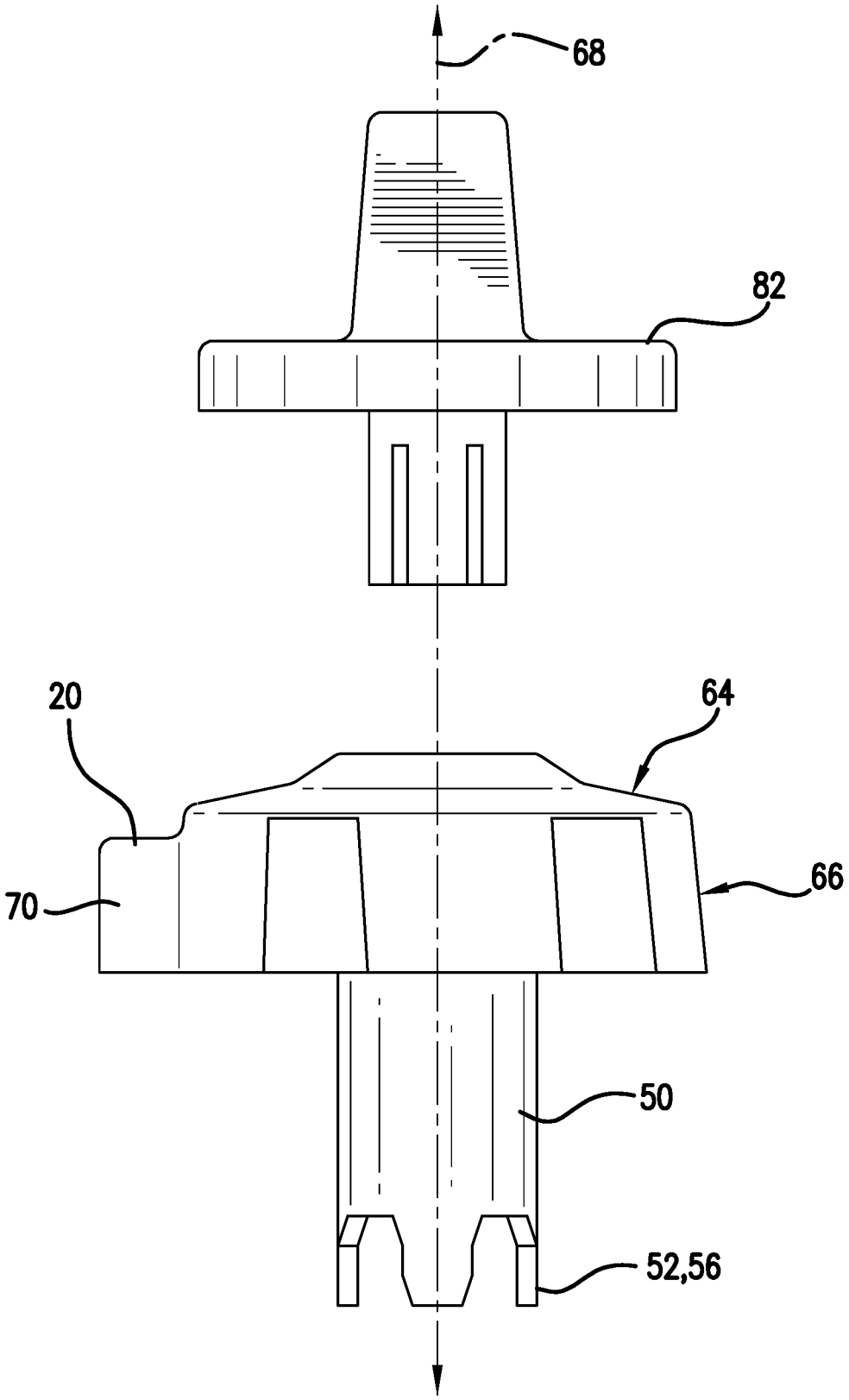
FIG. 4 is a side elevation view of a choke handle.

Rotation of the choke transmission member 74 causes a corresponding rotation of the rotational member 88 due to the engagement between these two members. The choke handle 82 can be attached to the choke transmission member 74 in a variety of manners. With reference to FIG. 4, the choke handle 82 has a gripping portion on its upper terminal end that can be grasped by the fingers and/or thumb of the user for rotation of the choke handle 82. The choke handle 82 also includes on an opposite terminal end a receiving portion that has a cavity with a rectangular cross-sectional shape that can receive the upper terminal end of the choke transmission member 74. As shown, a pair of slots extend in the longitudinal direction along the longitudinal axis 68. The portion of the choke handle 82 between these two slots is thus deflectable. A projection not visible in FIG. 4 can extend from this portion of the choke handle 82 into the cavity. When placed onto the upper terminal end of the choke transmission member 74, the projection engages the choke transmission member 74 and deflects this portion outwards to allow the choke transmission member 74 to be slid into the cavity of the choke handle 82. With reference now to FIGS. 2 and 3, once the projection reaches an aperture that extends through the choke transmission member 74, the projection and the portion of the choke handle 82 will snap back into their normal detached, at rest position. As shown in FIG. 3, the projection will be retained within the aperture of the choke transmission member 74 and the choke handle 82 will be retained onto the choke transmission member 74. The choke handle 82 will thus be retained onto the choke transmission member 74 and these two components will not rotate relative to one another. A user may detach the choke handle 82 by applying force sufficient to pop the projection out of the aperture of the choke transmission member 74 if removal is desired. It is to be understood that other mechanisms of attaching the choke handle 82 to the choke transmission member 74 are possible in other exemplary embodiments and that the disclosed arrangement is but one example.

The rotational member 88 includes a pair of ridges with a groove defined therebetween. The upper ridge, that is the one closer to the choke handle 82 in the longitudinal direction in FIG. 3 is not completely continuous but has a small notch. The lower ridge is in fact continuous about the circumference of the rotational member 88. An internal surface of an idle down transmission shaft 50 has a projection that extends into the interior cavity of the idle down transmission shaft 50 and can move through the notch of the rotational member 88. The projection does not extend around the entire inner circumference of the interior cavity of the idle down transmission shaft 50. A ridge extends completely about the entire inner circumference of the interior cavity of the idle down transmission shaft 50 and prevents longitudinal movement of the rotational member 88 past this point. The projection can be received between the upper and lower ridges of the rotational member 88 to fix the relative longitudinal positions of the rotational member 88 and the idle down transmission shaft 50. The rotational member 88 may rotate relative to the idle down transmission shaft 50. Since the rotational member 88 is rigidly connected to the choke handle 82, the choke transmission member 74, the coil spring engagement member 88, and the choke valve 72, these components can also rotate relative to the idle down transmission shaft 50.

The idle down transmission shaft 50 is part of the idle down feature 14 and is composed of a first piece 52 and a second piece 54. It is to be understood, however, that in other exemplary embodiments any number of pieces may be used to construct the idle down transmission shaft 50. For example, from 3-5, from 6-10, or up to 20 pieces may make up the idle down transmission shaft 50. In yet other arrangements, the idle down transmission shaft 50 is made of a single piece. The first piece 52 has teeth 56 on its lower terminal end in the longitudinal direction. The second piece 54 has teeth 58 on its upper terminal end in the longitudinal direction. The teeth 56 and 58 can interlock or mesh with one another. Rotational movement of the first piece 52 is thus transferred to the second piece 54 through this connection so that the first and second pieces 52 and 54 both rotate and do not move relative to one another. However, other connection mechanisms are possible in other exemplary embodiments.

With reference to both FIGS. 2 and 3, the idle down handle 20 is attached to the first piece 52 and in some embodiments may be integrally formed with the first piece 52. Rotation of the idle down handle 20 is thus transferred to and causes the first piece 52 and second piece 54 to likewise rotate. The idle down handle 20 has a top surface 64 and a side surface 66 that extends from the top surface 64 in the longitudinal direction. The side surface 66 has a generally consistently sized radius from the longitudinal axis 68. However, a thumb gripping portion 70 extends outwards from the consistently sized radius portion of the side surface 66. The thumb gripping portion 70 thus extends farther in the radial direction from the longitudinal axis 68 than the remaining portion of the side surface 66. The thumb gripping portion 70 may be used by the user to place his or her thumb thereon when effecting rotation of the idle down handle 20. When used in connection with a snow blower 12, the user may have gloves on his or her hands which make actuating some buttons or switches difficult. The provision of a thumb gripping portion 70 may make it easier for the user to grasp and turn the idle down handle 20 in these circumstances. However, the thumb gripping portion 70 need not be present in other arrangements of the idle down handle 20.

Rotation of the idle down handle 20 and idle down transmission shaft 50 is completely independent of rotation of the choke handle 82, choke transmission member 74, and choke valve 72. As such, the user can turn the idle down handle 20 without causing any movement of the choke valve 72. However, these components can all share a common longitudinal axis 68 and thus may be coaxial with one another. In some arrangements, the choke transmission member 74 can extend completely through the entire idle down transmission shaft 50 and the idle down handle 20 in the longitudinal direction along the longitudinal axis 68. In this regard, the idle down transmission shaft 50 can surround a portion of the longitudinal length of the choke transmission member 74 along the entire longitudinal length of the idle down transmission shaft 50. The choke transmission member 74 can extend completely through the idle down handle 20 such that the idle down handle 20 completely surrounds the idle down transmission shaft 50 along a portion of the longitudinal length of the idle down transmission shaft 50.

FIG. 2 shows a throttle valve shaft 32 that is rotationally mounted to the housing 30. The throttle valve shaft 32 is attached to the throttle valve 16 in a rigid manner such that rotation of the throttle valve shaft 32 causes a corresponding rotation of the throttle valve 16. The throttle valve shaft 32 and the throttle valve 16 do not rotate relative to one another. The throttle valve 16 may be bolted, welded, integrally formed, or attached through other forms of mechanical fasteners to the throttle valve shaft 32. A revolve bracket 34 can be attached to the throttle valve shaft 32 so that these two components do not move relative to one another. Again, any suitable connection may be used to effect this type of attachment. Rotation of the revolve bracket 34 will cause rotation of the throttle valve shaft 32 that will likewise cause rotation of the throttle valve 16.

A throttle linkage member dip 36 is pivotally attached to the revolve bracket 34. In this regard, the throttle linkage member clip 36 can rotate relative to the revolve bracket 34 so that these two components can rotate relative to one another. However, the throttle linkage member dip 36 may be attached to the revolve bracket 34 so that these two components do not rotate relative to one another. A throttle linkage member 18 is attached to the throttle linkage member clip 36. This attachment may be made so that the throttle linkage member 18 does not rotate relative to the throttle linkage member dip 36. An end of the throttle linkage member 18 can extend through an aperture of the revolve bracket 34 and held via the throttle linkage member clip 36. The throttle linkage member 18 may be part of a throttle mechanism (not shown) of the snow blower 12 or other device to which the carburetor 10 is incorporated. The user may adjust a control device, such as the power controller 94, that in turn causes a force to be applied to or removed from the throttle linkage member 18 to cause this component to apply force to the revolve bracket 34. In this manner, the throttle linkage member 18 can cause the revolve bracket 34 to rotate back and forth and thus in turn cause the throttle valve 16 to move back and forth between a throttle valve closed position 26 and a throttle valve open position 28. The throttle linkage member 18 may thus apply force that controls the amount of speed and power output by the engine. In some arrangements, a mechanical linkage is used to transfer forces by the throttle linkage member 18. In other arrangements, the throttle linkage member 18 is electrically actuated in order to apply or remove forces from the revolve bracket 34.

Figure 5:
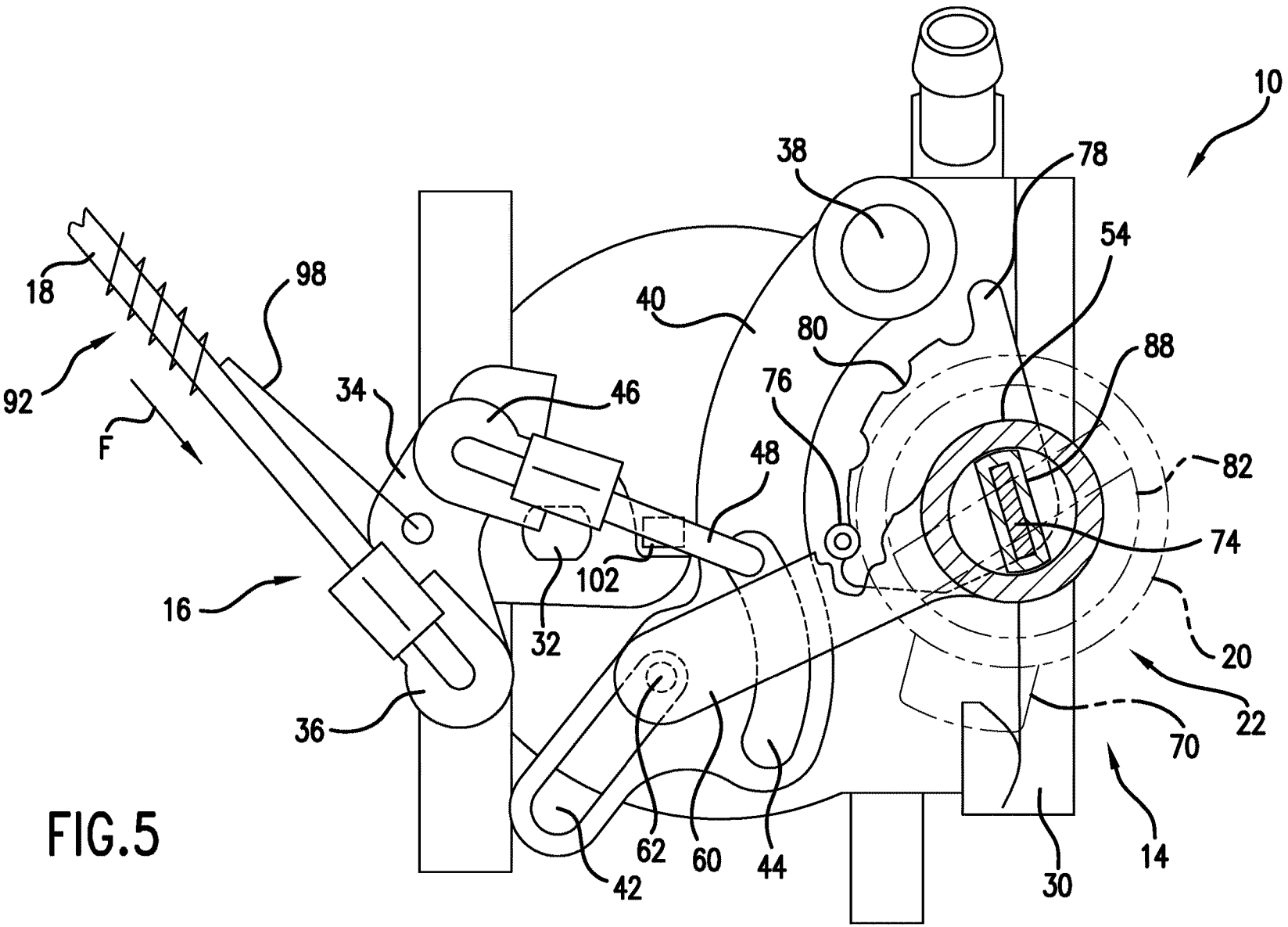
FIG. 5 is a top plan view, partially in cross-section of the carburetor with the throttle valve open and the choke valve closed and in which the idle down feature is unactuated.

FIG. 5 is a top view of the carburetor 10 with the first piece 52, idle down handle 20, and choke handle 82 removed for clarity. Although not visible in FIG. 5, the throttle valve 16 is in the throttle valve open position 28. The idle down feature 14 is in an unactuated state and thus does not function to act on or apply any forces to the throttle valve 16. The choke valve 72 is in a choke valve closed position 86 but this configuration does not effect the positioning of the throttle valve 16. The throttle linkage member 18 applies a force to the throttle linkage member clip 36 that is designated generally by the letter "F" in FIG. 5 that forces the revolve bracket 34 to rotate its full allowable distance in the counter clockwise direction. A projection 102 from the housing 30 extends upwards and engages an arm (visible in FIG. 2) of the revolve bracket 34 to prevent further counter clockwise rotation of the revolve bracket 34. The force applied by the throttle linkage member 18 may be its normal, at rest force, such that the throttle valve 16 is biased to a throttle valve open position 28. Springs or other mechanisms may be used to effect this force F. The throttle linkage member 18 may be in an unactuated position 92 as shown in FIG. 5. Force F may or may not be applied by the throttle linkage member 18 in the unactuated position 92 and this description is simply for purposes of description.

Figure 6:
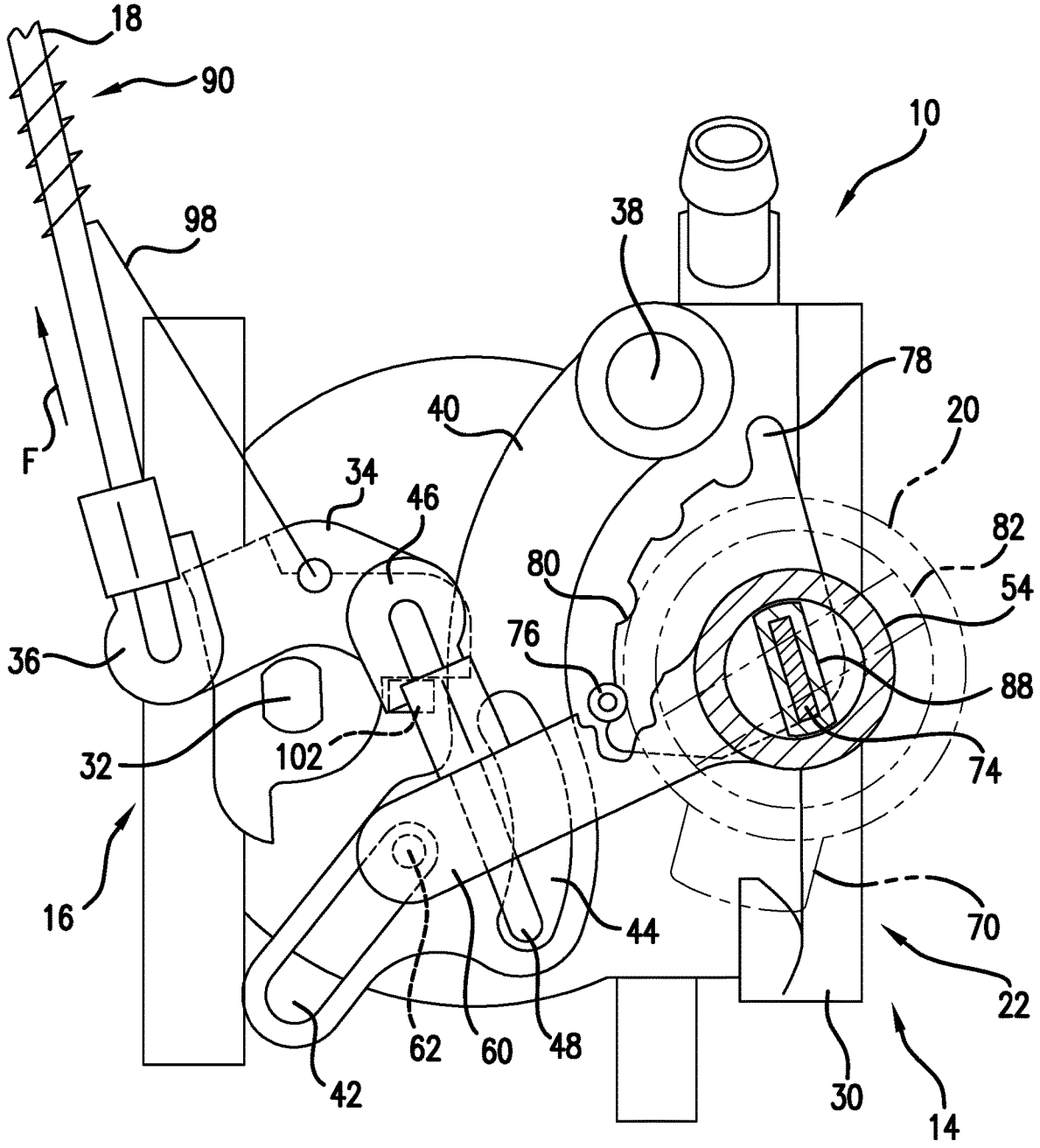
FIG. 6 is a top plan view similar to FIG. 5 but with the throttle valve closed and the choke valve closed and in which the idle down feature is unactuated.

Actuation of a power controller 94 or other control mechanism may cause the force F to be reversed in direction to cause the revolve bracket 34 to rotate from the position shown in FIG. 5 to that shown in FIG. 6 upon rotation in the clockwise direction. The throttle linkage member 18 is in the actuated position 90 in FIG. 6 and a different amount of force F or a different direction of force F is applied by the throttle linkage member 18 in the actuated position 90 versus the unactuated position 92. In the fully clockwise rotated position, the revolve bracket 34 causes the throttle valve shaft 32 to rotate that in turn causes the throttle valve 16 to assume the throttle valve closed position 26. This may represent an idle state of the carburetor 10. Of course any positioning of the revolve bracket 34 between the two extremes discussed will cause a corresponding partial open condition of the throttle valve 16 so that various speed or power output can be achieved. A downward extending arm of the revolve bracket 34, shown more dearly with reference to FIG. 2, can engage the other side of the same projection 102 of the housing 30 previously mentioned with respect to the other arm of the revolve bracket 34. This engagement will prevent further clockwise rotation of the revolve bracket 34 and act as a limitation of rotation.

Also of note upon comparison of FIGS. 5 and 6 is the movement of linkage member 48. Rotation of the revolve bracket 34 will cause the attached linkage member 48 to ride within a linkage member slot 44 of a transmission bracket 40. An end of the linkage member 48 will move from one end of the linkage member slot 44 all the way to the other end of the linkage member slot 44 upon movement of the revolve bracket 34 from its counter clockwise rotational limit in FIG. 5 to its clockwise rotational limit in FIG. 6. As such, the linkage member 48 does not function to limit rotation of the revolve bracket 34 when the idle down feature 14 is not actuated as is the case in the arrangements in FIGS. 5 and 6. In this state, the throttle linkage member 18 can apply force F in different directions to cause the throttle valve 16 to open and close. The idle down feature 14 does not have any impact on whether the throttle valve 16 is open or closed in this state and does not effect the functioning of the throttle linkage member 18. The choke valve 72 is in the choke valve closed position 86 but the positioning of the choke valve 72 does not effect the throttle linkage member 18 opening or closing the throttle valve 16.

The linkage member 18 may be a part of any linkage, motor, solenoid, gear train, belt, or other arrangement in accordance with various exemplary embodiments. In the disclosed embodiment, an aperture is defined through the revolve bracket 34 at a location between the point of attachment of the throttle linkage member dip 36 and the linkage member dip 46. An end of a spring 98 is attached to the revolve bracket 34 at this location by being disposed through this aperture. The end of the spring 98 may be hooked and this hook can be disposed through the aperture to effect attachment. The spring 98 is a coil spring and is located around a portion of the linkage member 18. The spring 98 functions to provide a force to the linkage member 18 that may augment the force F provided by the linkage member 18 to the revolve bracket 34 and/or to urge the linkage member 18 in a direction normal to the length of the linkage member 18. The spring 98 need not be present in other arrangements of the carburetor 10.

With reference to FIGS. 2, 5 and 6, portions of the idle down feature 14 will now be described. The linkage member dip 46 is rotationally attached to the revolve bracket 34, and an end of the linkage member 48 is attached to the linkage member dip 46 to place the linkage member 48 into rotational engagement with the revolve bracket 34. The end of the linkage member 48 extends through an aperture of the revolve bracket 34. The linkage member 48 does not rotate relative to the linkage member dip 46. A shore 38 extends in the vertical direction 100 upwards from the housing 30. The shore 38 may be integrally formed with the housing 30 or can be a component separate from the housing 30 but rigidly attached to the housing 30. The shore 38 does not move relative to the housing 30. An end of a transmission bracket 40 is attached to the shore 38 and is in rotational engagement with the shore 38 so that it can rotate relative to the shore 38. The transmission bracket 40 may thus rotate relative to the housing 30. The transmission bracket 40 defines an idle down transmission pin slot 42 and a linkage member slot 44. The slots 42 and 44 extend completely through the transmission bracket 40. The idle down transmission pin slot 42 has a curved shape such that it curves from a terminal end to an opposite terminal end. The linkage member slot 44 has a straight shape from one terminal end to the other and does not curve along its length. The widths of both of the slots 42 and 44 may be the same and not change along their lengths with the exception being at their terminal ends where they necessarily curve inwards and the width decreases. However, in other arrangements instead of having curved terminal ends, the terminal ends of the slots 42 and 44 may be straight.

In the arrangement shown in FIG. 5, the linkage member 48 is rotated to its most extreme clockwise position and engages the same projection 102 of the housing 30 previously noted as being engaged by the two arms of the revolve bracket 34. This projection 102 of the housing 30 thus limits rotational movement of the linkage member 48 in the clockwise direction. An end of the linkage member 48 extends through the linkage member slot 44 and is then turned 90°. This turning may in some instances help prevent the linkage member 48 from being disengaged and removed from the linkage member slot 44 due to its contact with the transmission bracket 40. Upward movement of the linkage member 48 in the vertical direction 100 will cause this turned end to contact the bottom surface of the transmission bracket 40. In other arrangements, the end of the linkage member 48 need not be turned.

The curvature of the length of the linkage member slot 44 corresponds to the curvature of the revolve bracket 34 in that the linkage member 48 rides along the entire length of the linkage member slot 44 from one of its terminal ends to the other upon rotation of the revolve bracket 34 between its most extreme clockwise position and its most extreme counter clockwise position. The linkage member 48 simply slides along the linkage member slot 44 upon comparison of FIGS. 5 and 6 and once it engages the terminal end of the linkage member slot 44 stops upon the revolve bracket 34 reaching its most clockwise position. The linkage member 48 does not provide any force onto the transmission bracket 40 to turn the transmission bracket 40 about shore 38. The revolve bracket 34 engages the projection 102 in its most clockwise and most counter clockwise positions and this engagement prevents the linkage member 48 from engaging and forcing the transmission bracket 40 to rotate.

The idle down feature 14 may have an idle down transmission pin 62 attached to an arm 60. The arm 60 and idle down transmission pin 62 do not move relative to one another. The arm 60 extends from the idle down transmission shaft 50 and is attached to the idle down transmission shaft 50 in such a manner that these two components do not move relative to one another. The arm 60 may be integrally formed with the second piece 54. The idle down transmission pin 62 is located within the idle down transmission pin slot 42. As shown upon comparison of FIGS. 5 and 6 the idle down transmission pin 62 does not move along the idle down transmission pin slot 42 when the throttle valve 16 is moved between its closed and open positions 26 and 28.

When the user desires to utilize the idle down feature 14, he or she will grasp the idle down handle 20 such that his or her thumb is on the thumb gripping portion 70. The user will then turn the idle down handle 20 from the unactuated position 22 to the actuated position 24. The unactuated position 22 is shown with reference to FIGS. 5 and 6, and the actuated position 24 of the idle down handle 20 is shown with reference to FIG. 7. Placement of the idle down handle 20 into the actuated position 24 causes rotation of the idle down transmission shaft 50 as previously described. This rotation will likewise cause the arm 60 and attached idle down transmission pin 62 to rotate since they are attached to the idle down transmission shaft 50 in such a manner that they do not move relative thereto. The rotation of the idle down transmission pin 62 will cause force to be imparted onto the transmission bracket 40 that will cause the transmission bracket 40 to rotate counter clockwise. The transmission bracket 40 is free to rotate because the idle down transmission pin 62 will ride along the idle down transmission pin slot 42 to accommodate rotation of the idle down transmission pin 62. The transmission bracket 40 rotates relative to the linkage member 48 along the linkage member slot 44. However, once the linkage member 48 rides along the entire length of the linkage member slot 44 and moves to the terminal end of the linkage member slot 44, the linkage member 48 engages the transmission bracket 40 and continued movement of the transmission bracket 40 pulls the linkage member 48.

Pulling of the linkage member 48 causes the linkage member dip 46 to likewise be pulled and pivoted which in turn cause the revolve bracket 34 to rotate in the clockwise direction. The linkage member 48 may be placed into an actuated position in FIG. 7. Clockwise rotation of the revolve bracket 34 will cause the throttle valve shaft 32 to rotate which will in turn cause the throttle valve 16 to move into the throttle valve closed position 26. The carburetor 10 will thus be placed into an idle via actuation of the idle down feature 14. The idle down handle 20 can be rotated in the counter clockwise direction until the transmission bracket 40 engages the choke transmission member 74. At this point, the idle down handle 20 has reached the actuated position 24 and the idle down feature 14 no longer moves. The rotational connection between the shore 38 and the transmission bracket 40 may be a tight connection in that a strong amount of force is needed to rotate the transmission bracket 40. As such, once the transmission bracket 40 has been rotated into engagement with the choke transmission member 74 it will remain in this position thus locking the throttle valve 16 into the throttle valve closed position 26. Force F applied by the throttle linkage member 18 will not be sufficient to rotate the revolve bracket 34 and thus the throttle linkage member 18 will not function to open the throttle valve 16 when the idle down feature 14 is actuated. The linkage member 48 is in an actuated position and force from the linkage member 48 prevents rotation of the revolve bracket 34 in the counter clockwise direction so that the throttle valve 16 cannot be opened. However, in other exemplary embodiments, the resistive forces of the throttle linkage member 18 or other portions of the idle down feature 14 can be overcome upon sufficient force F applied by the throttle linkage member 18 so that the throttle linkage member 18 can open the throttle valve 16 and thus itself pull the linkage member 48, transmission bracket 40, idle down transmission pin 62, arm 60, idle down transmission shaft 50, and idle down handle 20 back into their unactuated positions.

Figure 7:
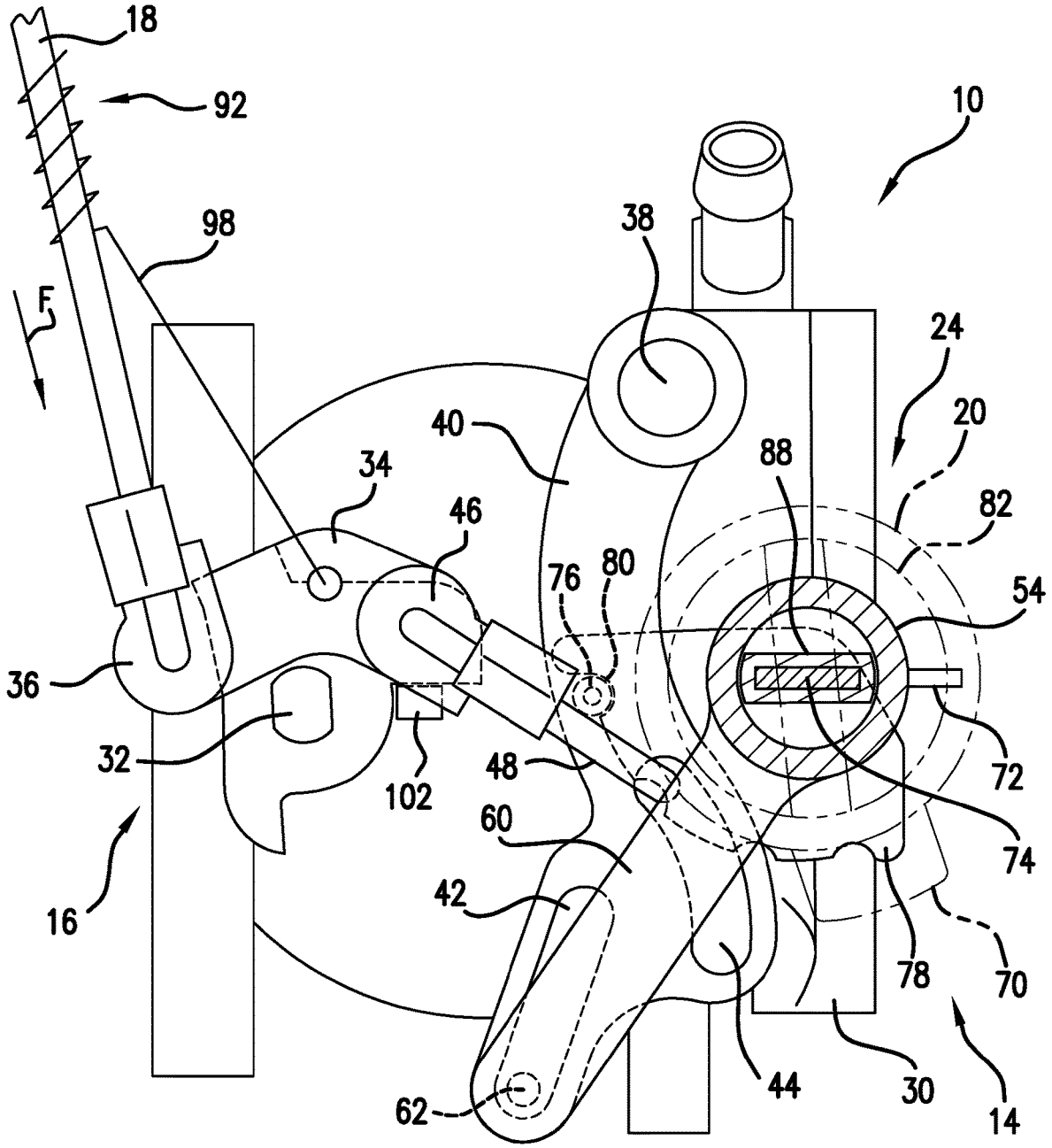
FIG. 7 is a top plan view, partially in cross-section of the carburetor with the idle down feature actuated to cause the throttle valve to be closed. The choke valve is in the open position.
Figure 8:
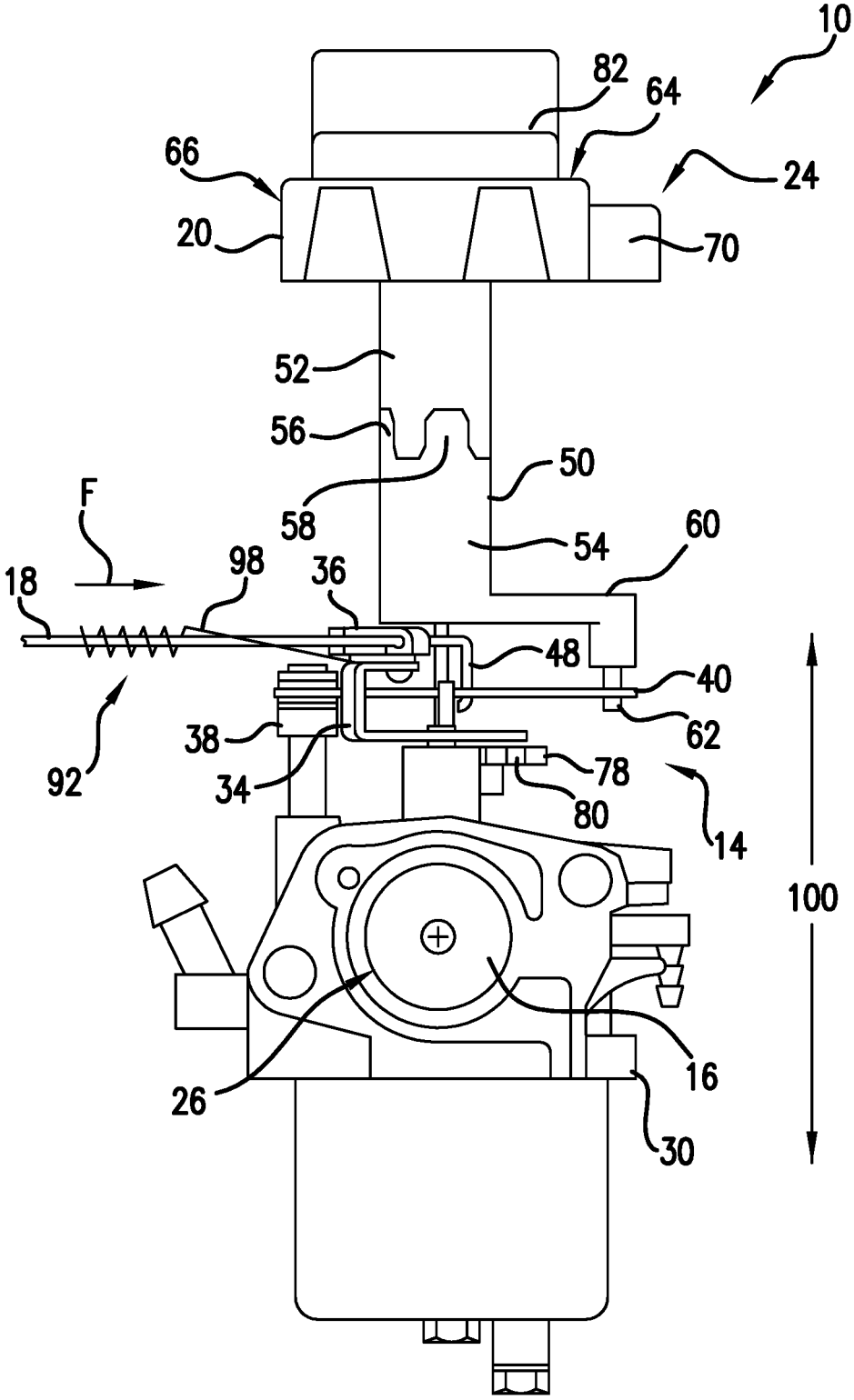
FIG. 8 is a front elevation view of the carburetor of FIG. 7.

A front view of the carburetor 10 is shown in FIG. 8 that is a front view of the top view shown in FIG. 7 in which the idle down feature 14 is in the actuated position. The throttle valve 16 is circular in shape and is attached to the throttle valve shaft 32 through a bolted connection. The throttle valve 16 is in the throttle valve closed position 26 and creates an idle condition effected by the carburetor 10.

Figure 9:
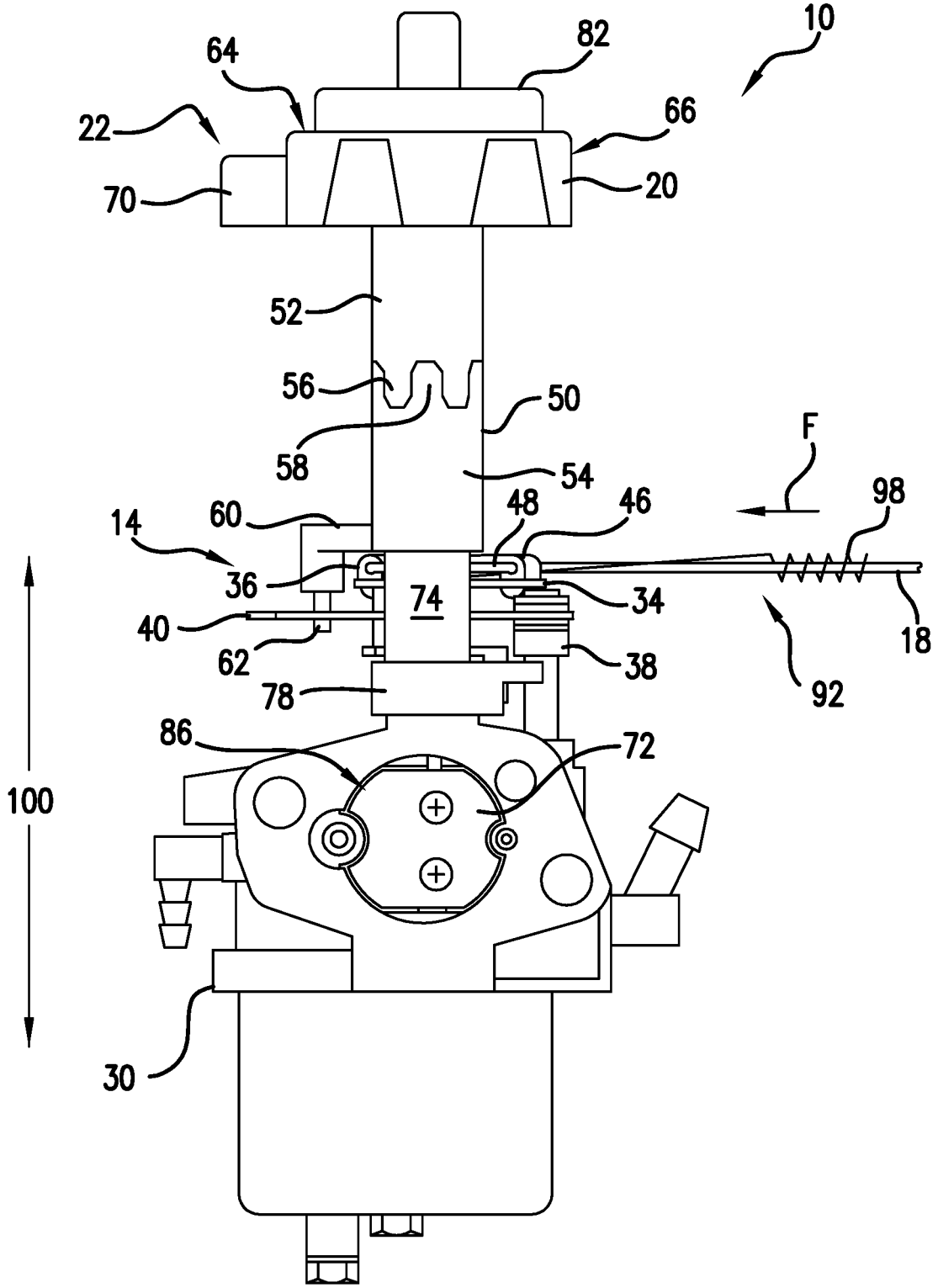
FIG. 9 is a back elevation view of a carburetor with the throttle valve open and the choke valve closed and in which the idle down feature is unactuated.

A back view of the carburetor 10 is shown in FIG. 9. The throttle valve 16 is in the throttle valve open position 28 although it cannot be viewed. The idle down feature 14 is unactuated. The choke valve 72 is in a choke valve closed position 86. The choke valve 72 reduces air flow into the carburetor 10 when in the choke valve closed position 86. The choke valve 72 is generally circular but has a pair of moon shaped cut outs to accommodate certain structure of the housing 30. The choke valve 72 is attached to the choke transmission member 74 through a pair of bolts so that the choke valve 72 does not move relative to the choke transmission member 74.

Figure 10:
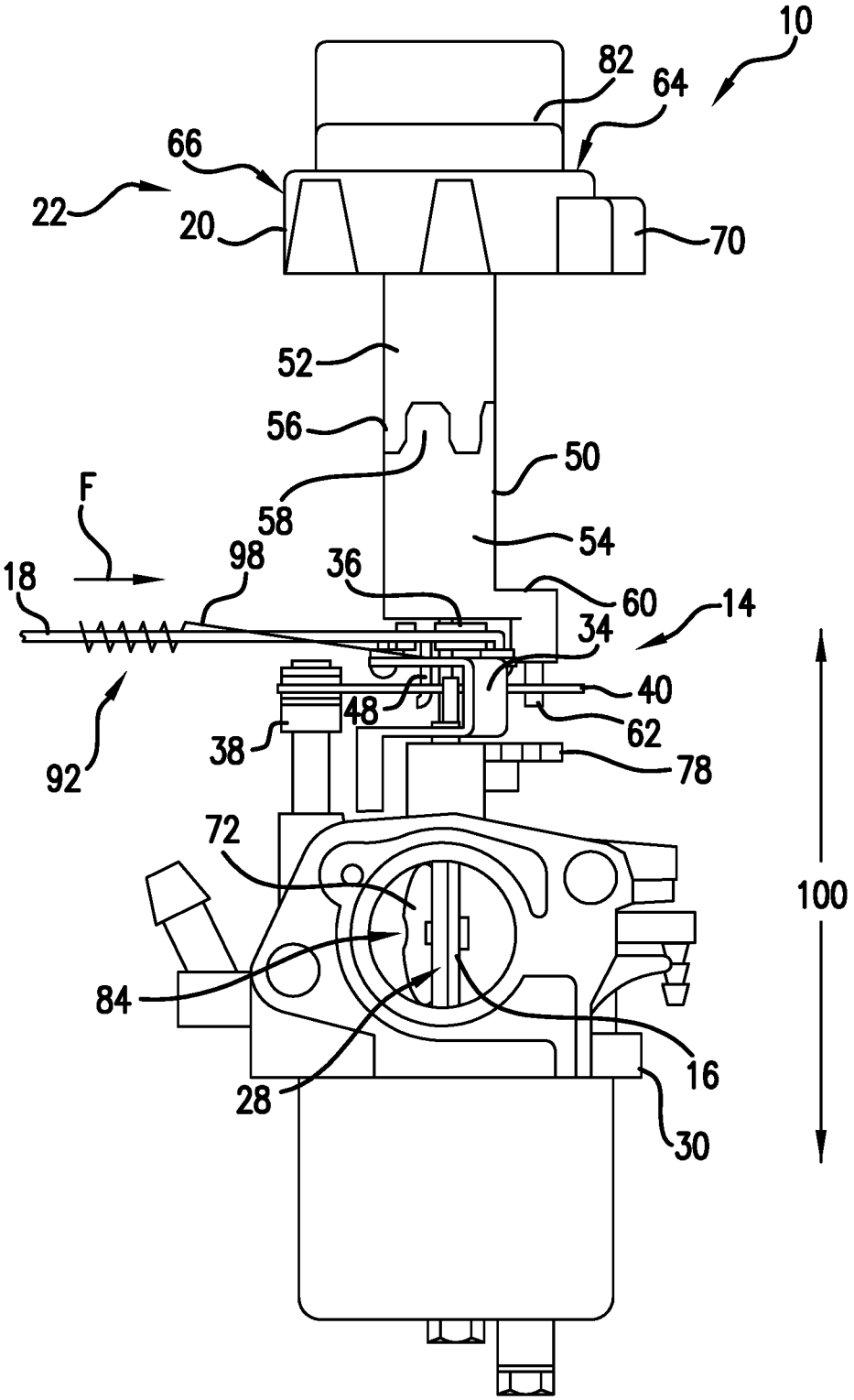
FIG. 10 is a front elevation view of a carburetor with the throttle valve open and the choke valve open and the idle down feature unactuated.
Figure 11:
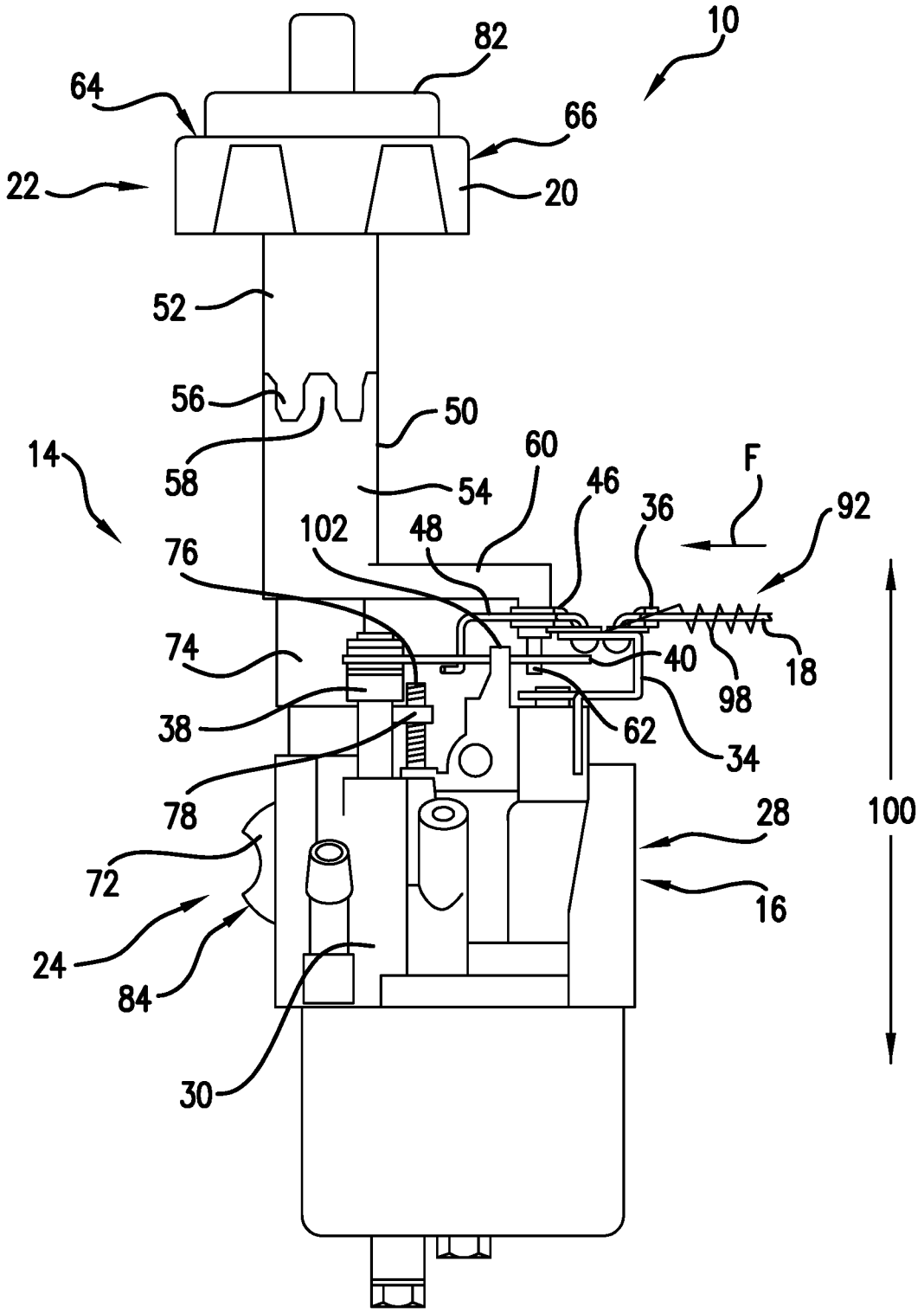
FIG. 11 is a right side elevation view of the carburetor of FIG. 10.
Figure 12:
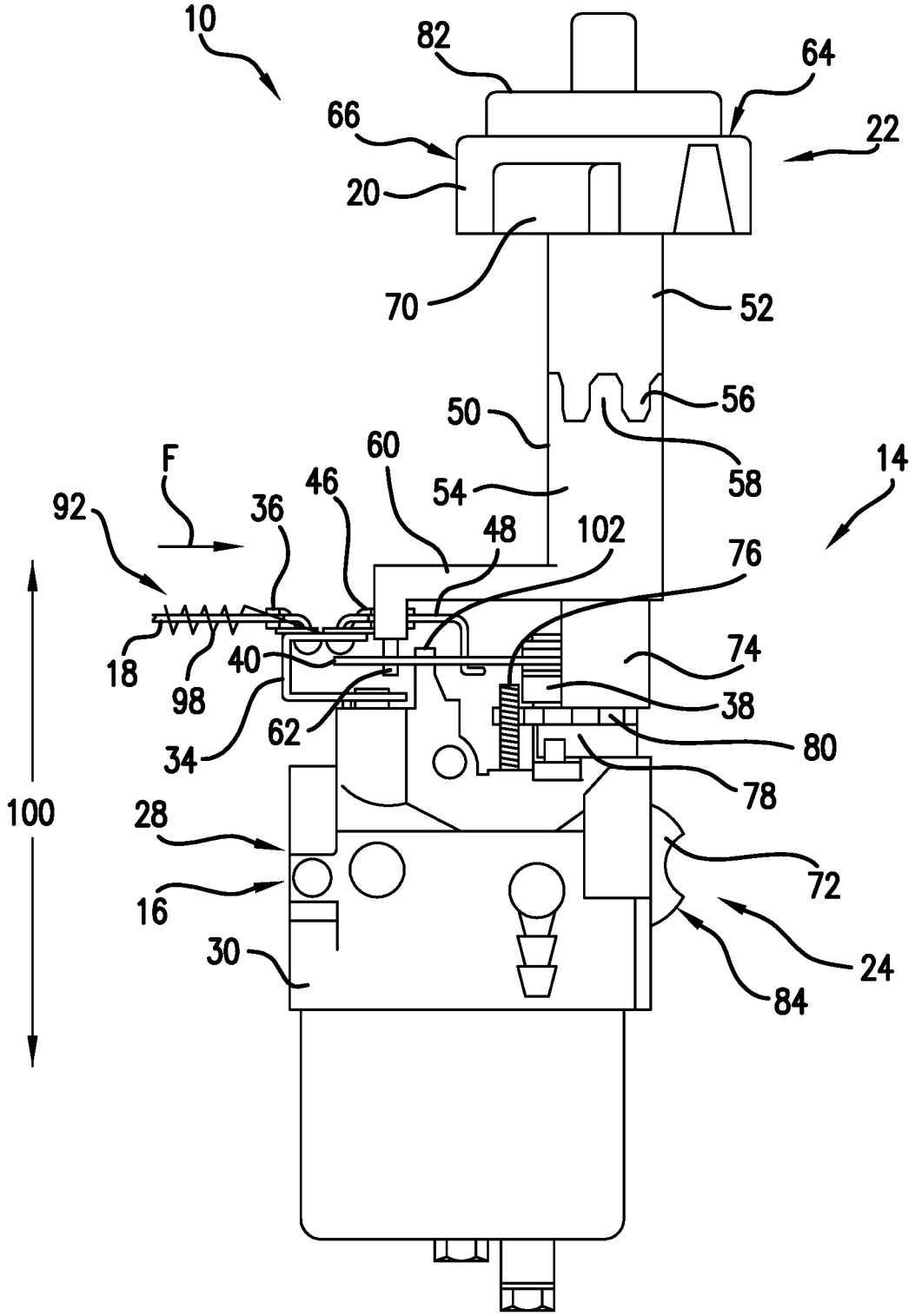
FIG. 12 is a left side elevation view of the carburetor of FIG. 10.

FIGS. 10-12 show a front view, right side view, and left side view of the carburetor 10 with the throttle valve 16 in the throttle valve open position 28 and the choke valve 72 in the choke valve open position 84. The idle down feature 14 is not actuated. In FIG. 10, the throttle valve 16 is shown in the throttle valve open position 28, and the choke valve 72 located behind the throttle valve 16 is located in the choke valve open position 84. The choke valve 72 may be more easily seen in the choke valve open position 84 in FIGS. 11 and 12.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. A carburetor, comprising:

a housing;

a throttle valve that can be moved between an open position and a closed position, wherein a throttle linkage member is in communication with the throttle valve and the throttle valve shaft is rigidly attached to the housing, wherein the throttle valve shaft rotates relative to the housing;

a revolve bracket rigidly attached to the throttle valve shaft, wherein the revolve bracket rotates relative to the housing;

a throttle linkage member clip that is rotationally mounted to the revolve bracket, wherein the throttle linkage member is attached to the throttle linkage member clip and can apply force thereto that is communicated to the throttle valve through the revolve bracket and the throttle valve shaft to move the throttle valve from the open position to the closed position, an idle down handle that can be moved from an unactuated position to an actuated position, wherein the idle down handle is in communication with the throttle valve, wherein movement of the idle down handle from the unactuated position to the actuated position causes the throttle valve to be placed into the closed position, wherein when the idle down handle is in the unactuated position the throttle linkage member can cause the throttle valve to be moved from the open position to the closed position and can cause the throttle valve to be moved from the closed position to the open position;

a shore that is rigidly attached to the housing;

a transmission bracket that is rotationally mounted to the shore, wherein the transmission bracket defines an idle down transmission pin slot and a linkage member slot;

a linkage member clip that is rotationally mounted to the revolve bracket;

a linkage member that is attached to the linkage member clip, wherein an end of the linkage member is disposed through the linkage member slot;

an idle down transmission shaft attached to the handle;

an arm that extends from the idle down transmission shaft and that is rigidly attached to the idle down transmission shaft; and an idle down transmission pin that is rigidly attached to the arm and that is disposed in the idle down transmission pin slot;

wherein the idle down handle is capable of being rotated, and wherein rotation of the idle down handle from, the unactuated position to the actuated position causes the idle down transmission shaft to rotate that causes the arm and the idle down transmission pin to rotate to cause the idle down transmission pin to ride within the idle down transmission pin slot to cause the transmission bracket to rotate relative to the shore to cause the linkage member to move to cause the linkage member clip to move to cause the revolve bracket to rotate to cause the throttle valve shaft to rotate to cause the throttle valve to rotate from the open position to the closed position.

2. The carburetor as set forth in claim 1, wherein the idle down transmission shaft is made of a first piece that is integrally attached to the idle down handle and a second piece that is integrally attached to the arm, wherein the first piece has first teeth on one end, wherein the second piece has second teeth on one end, wherein the first teeth and the second teeth are interlocked with one another such that rotation of the first piece is transmitted to the second piece to cause the second piece to rotate.

3. The carburetor as set forth in claim 1, wherein the idle down handle has a top surface and a side surface, wherein the side surface extends about a longitudinal axis, wherein a thumb gripping portion extends from the side surface and is the portion of the idle down handle farthest from the longitudinal axis in the radial direction.

4. The carburetor as set forth in claim 1, further comprising:

a choke valve that can be moved between an open position and a closed position; and a choke transmission member rigidly attached to the choke valve, wherein movement of the choke transmission member causes movement of the choke valve, wherein the choke transmission member extends through the idle down handle, and wherein movement of the idle down handle from the unactuated position to the actuated position does not cause movement of the choke transmission member.

5. The carburetor as set forth in claim 4, further comprising a deflectable coil spring;

a coil spring engagement member rigidly attached to the choke transmission member, wherein a plurality of detents are defined on the coil spring engagement member, wherein the deflectable coil spring is located within one of the detents; and a choke handle rigidly attached to the choke transmission member, wherein rotational movement of the choke handle causes rotational movement of the choke transmission member, the coil spring engagement member, and the choke valve, wherein rotation of the choke handle is not translated to the throttle valve to cause movement of the throttle valve.

* * * * *